United States Patent [19]

Takeda

[11] 4,321,900

[45] Mar. 30, 1982

[54] FUEL INJECTION TYPE INTERNAL COMBUSTION ENGINE

[75] Inventor: Keiso Takeda, Susono, Japan

[73] Assignee: Toyota Jidosha Kogyo Kabushiki Kaisha, Toyota, Japan

[21] Appl. No.: 84,154

[22] Filed: Oct. 12, 1979

[51] Int. Cl.[3] ..... F02D 1/04

[52] U.S. Cl. ..... 123/339; 123/587; 123/585; 123/327

[58] Field of Search ..... 123/339, 452, 585, 586, 123/587, 588, 589, 327

[56] References Cited

U.S. PATENT DOCUMENTS

| | | | |
|---|---|---|---|
| 1,184,611 | 5/1916 | Boucher | 123/585 |
| 2,869,527 | 1/1959 | Groves | 123/139 |
| 3,503,594 | 3/1970 | Goto | 123/339 |
| 3,661,131 | 5/1972 | Groff | 123/339 |
| 4,034,733 | 7/1977 | Noguchi | 123/139 |
| 4,203,395 | 5/1980 | Cromas | 123/339 |

FOREIGN PATENT DOCUMENTS

| | | | |
|---|---|---|---|
| 950776 | 2/1964 | United Kingdom | 123/139 AW |

*Primary Examiner*—Charles J. Myhre
*Assistant Examiner*—Carl Stuart Miller
*Attorney, Agent, or Firm*—Kenyon & Kenyon

[57] ABSTRACT

An internal combustion engine comprising a vertically extending intake duct which is arranged on the collecting portion of the intake manifold. A throttle valve and a fuel injector are arranged in the intake duct. A bypass passage is formed in the wall of the intake duct for communicating the inside of the intake duct located upstream of the throttle valve with the inside of the intake duct located downstream of the throttle valve.

17 Claims, 9 Drawing Figures

FUEL INJECTION TYPE INTERNAL COMBUSTION ENGINE

BACKGROUND OF THE INVENTION

The present invention relates to a fuel injection type internal combustion engine.

An internal combustion engine of a gasoline injection type has been proposed in which a fuel injector is provided for each cylinder, and the fuel is injected from each of the fuel injectors into the intake ports of the corresponding cylinders. This engine has an advantage in that the distribution of fuel to each cylinder becomes uniform. However, in this engine, there is a problem in that the atomization of the fuel fed into the combustion chambers from the fuel injectors is not fully promoted, and that the provision of a plurality of the fuel injectors is necessary. In order to eliminate the above-mentioned problem, another internal combustion engine has been proposed, in which a single fuel injector is arranged upstream of the throttle valve in the intake duct which is connected to the collecting portion of the intake manifold. This engine has advantages in that, since the fuel injected from the fuel injector impinges upon the throttle valve, the atomization of the fuel is promoted, and that the vaporization of the fuel is promoted during the time the fuel flows within the intake manifold. However, in this engine, there are problems in that, since the amount of the fuel distributed to each cylinder varies between the cylinders in accordance with changes in the opening degree of the throttle valve, the irregularity of the air-fuel ratio in each cylinder becomes large, and that, since it takes long time until the fuel injected from the fuel injector reaches the combustion chambers, the time lag of the responsiveness of the controlling operation of the fuel injection is increased.

In addition, a further internal combustion engine has been proposed, in which a single fuel injector is so arranged that the fuel is injected into the collecting portion of the intake manifold from the fuel injector. This engine has an advantage in that the responsiveness of the controlling operation of the fuel injection is improved as compared with the case wherein the fuel injector is arranged at a position located upstream of the throttle valve as mentioned above. However, in this engine, the atomization of the fuel injected from the fuel injector is not fully promoted as compared with the case wherein the fuel injector is arranged at a position located upstream of the throttle valve and, in addition, since the slight changes in the location of the fuel injector and in the injecting direction of the fuel injector cause a great change in the distribution of the fuel to each cylinder, it is difficult to practically find the optimum location and the optimum injecting direction of the fuel injector.

SUMMARY OF THE INVENTION

An object of the present invention is to provide an internal combustion engine capable of fully promoting the atomization of the fuel and capable of obtaining a uniform distribution of the fuel to each cylinder, as well as capable of ensuring a good responsiveness of the controlling operation of the fuel injection.

According to the present invention, there is provided a fuel injection type internal combustion engine comprising: an engine body; an intake duct fixed onto said engine body and defining an intake passage therein; a throttle valve arranged in said intake passage; a fuel injector having a fuel nozzle arranged in said intake passage; and bypass means communicating said intake passage located upstream of said throttle valve and said intake passage located downstream of said throttle valve.

The present invention may be more fully understood from the description of preferred embodiments of the invention set forth below, together with the accompanying drawings.

DESCRIPTION OF PREFERRED EMBODIMENTS

Figure 1:
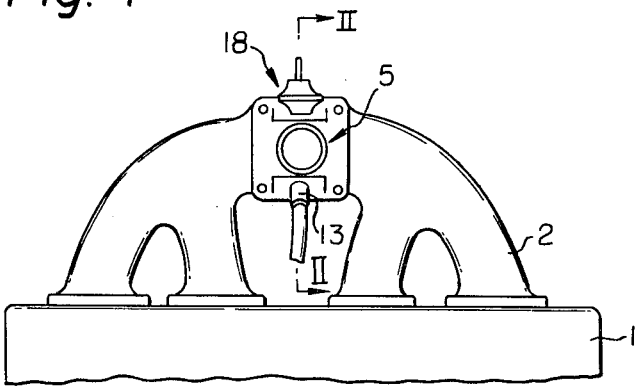
FIG. 1 is a plan view of a part of an embodiment of an internal combustion engine according to the present invention.
Figure 2:
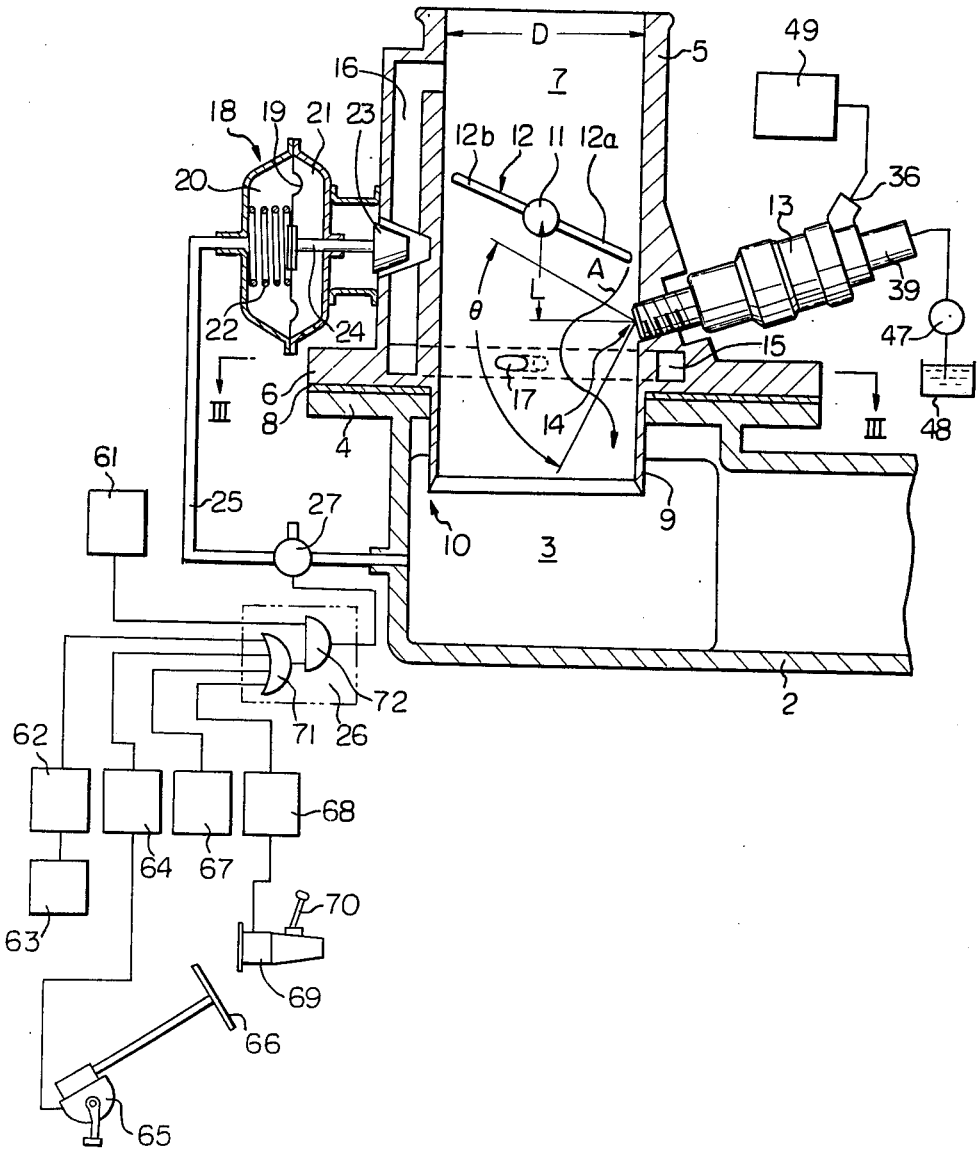
FIG. 2 is a cross-sectional side view taken along the line II—II in FIG. 1.

Referring to FIGS. 1 and 2, 1 designates an engine body, 2 an intake manifold fixed onto the engine body 1, and 3 a collecting portion of the intake manifold 2; 4 designates a horizontally extending manifold flange formed in one piece on the intake manifold 2 and arranged above the collecting portion 3, and 5 an approximately cylindrical intake duct having a mounting flange 6 which is formed in one piece on the lower end of the intake duct 5. A cylindrical intake passage 7 extending vertically and having a substantially uniform cross-section is formed in the intake duct 5. As illustrated in FIG. 2, the mounting flange 6 of the intake duct 5 is fixed onto the manifold flange 4 via a gasket 8, and a cylindrical member 9 having a thin wall and projecting downwards into the collecting portion 3 of the intake manifold 2 is formed in one piece on the lower end of the intake duct 5. The lower end 10 of the cylindrical member 9 has a knife edge shape and is arranged so as to be spaced from the peripheral side wall of the collecting portion 3 of the intake manifold 2. A throttle shaft 11 extending in parallel with the longitudinal axis of the engine body 1 (FIG. 1) is arranged in the intake passage 7, and a throttle valve 12, which is shaped in the form of a butterfly valve, is fixed onto the throttle shaft 11. For the sake of later explanation, hereinafter, the valve plate of the throttle valve 12 which is located at a position near the engine body 1 (FIG. 1) with respect to the throttle shaft 11 is refered to as a right valve plate 12*a*, and the valve plate of the throttle valve 12 which is located at a position remote from the engine body 1 (FIG. 1) with respect to the throttle shaft 11 is referred to as a left valve plate 12*b*. The throttle shaft 11 of the throttle valve 12 is connected to the accelerator pedal (not shown), so that the throttle valve 12 is rotated in the clockwise direction when the accelerator pedal is depressed. A swirl type fuel injector 13 is arranged on the inner wall of the intake passage 7, which is located at a position downstream of the throttle valve 12 and near the engine body 1 (FIG. 1). As illustrated in FIG. 2, the fuel injector 13 is so arranged that a fuel nozzle 14 thereof is directed slightly downwards, and that the distance L between the fuel nozzle 14 and the throttle shaft 11 is less than one half of the diameter D of the intake passage 7.

Figure 3:
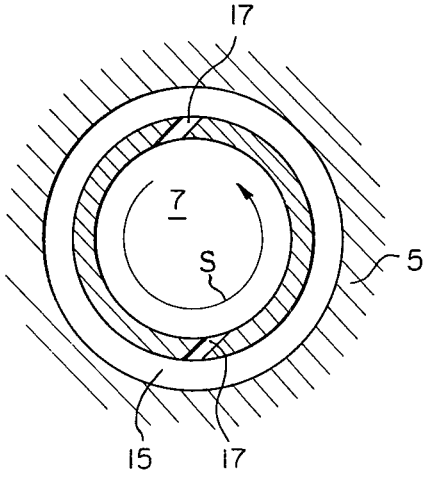
FIG. 3 is a cross-sectional view taken along the line III—III in FIG. 2.

An annular passage 15 arranged around the intake passage 7 is formed in the wall of the intake duct 5 located at a position downstream of the fuel injector 13, and this annular passage 15 is connected via a vertically extending bypass passage 16 to the intake passage 7 located upstream of the throttle valve 12. As illustrated in FIGS. 2 and 3, a pair of air ports 17 communicating the annular passage 15 and the intake passage 7 are formed on the inner wall of the intake passage 7, and both the air ports 17 are tangentially connected to the inner wall of the intake passage 7. As illustrated in FIG. 2, a vacuum operated diaphragm apparatus 18 is mounted on the intake duct 5 located at a position opposite the fuel injector 13 with respect to the intake passage 7. The diaphragm apparatus 18 comprises a vacuum chamber 20 and an atmospheric pressure chamber 21 which are separated by a diaphragm 19, and a compression spring 22 is arranged in the vacuum chamber 20 for biasing the diaphragm 19 towards the atmospheric pressure chamber 21. A valve body 23 for controlling the cross-sectional area of the bypass passage 16 is inserted into the bypass passage 16 and connected to the diaphragm 19 via a valve rod 24. The vacuum chamber 20 is connected to the collecting portion 3 of the intake manifold 2 via a vacuum conduit 25, and an electromagnetic valve 27 controlled by an electronic control circuit 26 is arranged in the vacuum conduit 25. The electromagnetic valve 27 normally interconnects the vacuum chamber 20 to the atmosphere, and in this condition, since the diaphragm 19 moves towards the right in FIG. 2 due to the spring force of the compression spring 22, the valve body 23 closes the bypass passage 16. On the other hand, when the solenoid (not shown) of the electromagnetic valve 27 is energized, the vacuum chamber 20 is connected to the inside of the intake manifold 2 by the change-over operation of the electromagnetic valve 27. At this time, since a vacuum is produced in the vacuum chamber 20, the diaphragm 19 moves towards the left in FIG. 2 against the spring force of the compression spring 22, and as a result, the valve body 23 opens the bypass passage 16. When the engine is operating, the pressure in the intake passage 7 located upstream of the throttle valve 12 is approximately equal to the atmospheric pressure, and the vacuum is produced in the intake manifold 2 located downstream of the throttle valve 12. Consequently, when the valve body 23 opens the bypass passage 16, a part of the sucked air is injected from the air ports 17 into the intake passage 7 via the bypass passage 16 and the annular passage 15, due to the pressure difference between the upstream side and the downstream side of the throttle valve 12, and as a result, a strong swirl motion, shown by the arrow S in FIG. 3, is created in the intake passage 7.

In addition, as is illustrated in FIG. 2, five switches 61, 62, 64, 67, 68 are connected to the electronic control circuit 26. The first switch 61 is connected, for example, to the throttle shaft 11 of the throttle valve so that when the throttle valve 12 is in the idling position, the first switch 61 is turned to the ON condition. The second switch 62 is connected to a cooling system 63 of a vehicle so that when the cooling system 63 is operated, the second switch 62 is turned to the ON condition. The third switch 64 is connecting to a power steering system 65 of a vehicle so that when a steering handle 66 is turned to its extreme position, the third switch 64 is turned to the ON condition. The fourth switch 67 is fixed, for example, onto the engine body 1 (FIG. 1) so that when the temperature of the engine body 1 is less than a predetermined level, the fourth switch 67 is turned to the ON condition. The fifth switch 68 is connected to a torque converter 69 of the engine so that when a manual control handle 70 of the torque converter 69 is positioned at the auto-drive range, the fifth switch 68 is turned to the ON condition.

In addition, as illustrated in FIG. 2, the electronic control circuit 26 comprises an OR circuit 71 and an AND circuit 72, and the switches 62, 64, 67, 68 are connected to the inputs of the OR circuit 71. The output of the OR circuit 71 is connected to one of inputs of the AND circuit 72, and the switch 61 is connected to the other input of the AND circuit 72. In addition, the output of the AND circuit 72 is connected to the electromagnetic valve 27. As is known to those in skilled in the art, when at least one of the four inputs of the OR circuit 71 is turned to the ON condition, the output of the OR circuit 71 is turned to the ON condition. On the other hand, only when both inputs of the AND circuit 72 are turned to the ON condition is the output of the AND circuit 72 turned to the ON condition. Consequently, it will be understood that when the first switch 61 is in the ON condition and, at the same time, when at least one of the switches 62, 64, 67, 68 is in the ON condition, the electromagnetic valve 27 is energized, and the valve body 23 opens the bypass passage 16. That is, it will be understood that when the throttle valve 12 is in the idling position and, for example, when the cooling system 63 is operated, the valve body 23 opens the bypass passage 16.

When the valve body 23 opens the bypass passage 16, a part of the sucked air is fed into the intake manifold 2 from the air inlets 17 via the bypass passage 16, and the rotation speed of the engine is increased as compared with the case where the engine is operating in a normal idling condition. Consequently, in the embodiment illustrated in FIG. 2, when the first switch 61 and at least one of the switches 62, 64, 67, 68 are in the ON condition, that is, when it is necessary to increase the rotation speed of the engine which is operating in an idling condition, a part of the sucked air is fed into the intake manifold 2 from the air ports 17, and the rotation speed of the engine is increased.

In the embodiment illustrated in FIG. 2, the electronic control circuit 26 comprises a simple circuit merely capable of energizing or de-energizing the electromagnetic valve 27 for selectively connecting the vacuum chamber 20 to the inside of the intake manifold 2 or to the atmosphere. However, instead of using such a simple circuit, an electronic control circuit may be used which is capable of intermittently energizing the electromagnetic valve 27. In this electronic control circuit, the length of time during which the electromagnetic valve 27 is energized is changed in accordance with a change in the operating condition of the engine. As a result, the level of the vacuum produced in the vacuum chamber 20 is controlled and, accordingly, the cross-sectional area of the bypass passage 16 is controlled by the valve body 23. A method of controlling the level of the vacuum produced in the vacuum chamber by changing the duty ratio of the drive pulse driving the electromagnetic valve is known in the art and, therefore, a detailed description of the method is omitted here.

In addition, the electromagnetic valve 27 may be removed from the vacuum conduit 25. In this case, since the vacuum chamber 20 is always connected to the inside of the intake passage 2, when the engine is operating under a partial load, a part of the sucked air is fed into the intake manifold 2 from the air ports 17.

Figure 4:
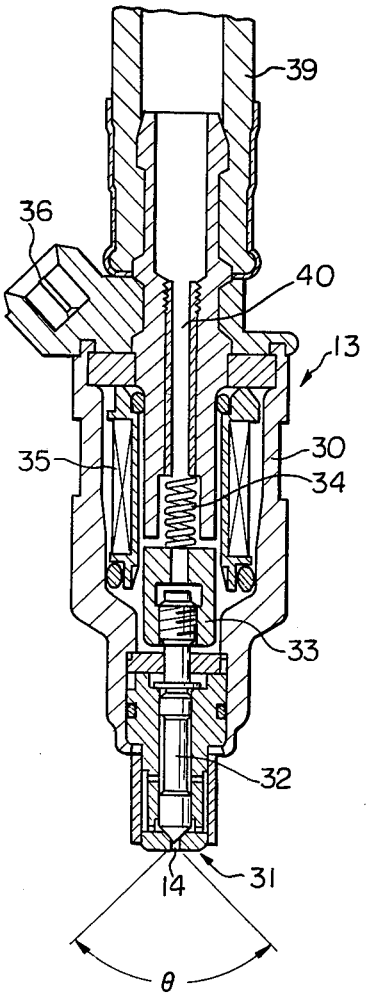
FIG. 4 is a cross-sectional side view of the fuel injector illustrated in FIG. 2.
Figure 5:
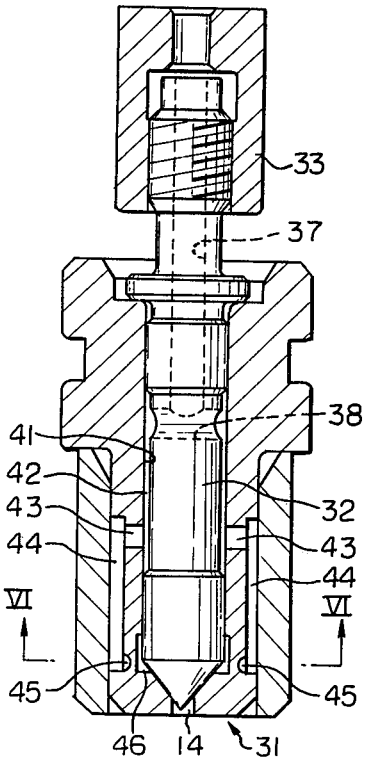
FIG. 5 is an enlarged cross-sectional side view of a part of the fuel injector illustrated in FIG. 4.
Figure 6:
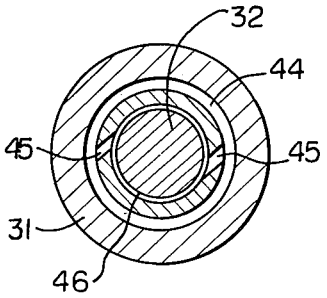
FIG. 6 is a cross-sectional view taken along the line VI—VI in FIG. 5.

Referring to FIGS. 4 and 5, reference numeral 30 designates an injector housing, 31 a valve holder fixed onto the tip of the housing 30, 32 a needle reciprocally movable within the valve holder 31 for controlling the opening operation of the fuel nozzle 14, and 33 a movable core fixed onto the upper end of the movable needle 32; 34 designates a compression spring for biasing the movable needle 32 towards the fuel nozzle 14, 35 a solenoid for attracting the movable core 33, and 36 a connector for supplying the solenoid 35 with electric power. As illustrated by the broken line in FIG. 5, an axial bore 37 and a radial bore 38 are formed within the movable needle 32. Consequently, the fuel fed into a fuel passage 40 (FIG. 4) from a fuel conduit 39 is fed via the axial bore 37 and the radial bore 38 into an annular chamber 42 formed between the movable needle 32 and a cylindrical inner wall 41 of the valve holder 31. As illustrated in FIGS. 5 and 6, the annular chamber 42 is connected to a swirl chamber 46 via a pair of radial bores 43, an annular chamber 44 and a pair of fuel ports 45. As illustrated in FIG. 2, the fuel conduit 39 of the fuel injector 13 is connected to a fuel tank 48 via a fuel pump 47. In addition, the connector 36 of the solenoid 35 of the fuel injector 13 is connected to an electronic control circuit 49 for controlling the injecting operation of the fuel injector 13.

Turning to FIGS. 4 and 5, when the solenoid 35 is energized in response to the output signal of the electronic control circuit 49 (FIG. 2) and, as a result, the movable needle 32 opens the fuel nozzle 14, the fuel fed into the annular chamber 42 from the fuel conduit 39 flows into the swirl chamber 46 via the radial bores 43, the annular chamber 44 and the fuel ports 45, and then is injected from the fuel nozzle 14. As illustrated in FIG. 6, both the fuel ports 45 are tangentially connected to the circumferential inner wall of the swirl chamber 46. Consequently, when the movable needle 32 opens the fuel nozzle 14, a strong swirl motion of the fuel is created in the swirl chamber 46 by the fuel flowing into the swirl chamber 46 from the fuel ports 45. Then, the swirling fuel in the swirl chamber 46 is injected, while swirling, from the fuel nozzle 14 and, as a result, the fuel injected from the fuel nozzle 14 spreads as illustrated in FIG. 4 due to the centrifugal force caused by the swirling motion. As mentioned above, in the swirl type fuel injector 13 as illustrated in FIG. 2, since the fuel injected from the fuel injector 13 spreads while swirling, the atomization of the fuel is extremely promoted. In addition, in the case wherein the fuel injector 13 is arranged as illustrated in FIG. 2, it has been proven that it is preferable that the injection angle shown by $\phi$ in FIGS. 2 and 4 be in the range of 60 through 120 degrees. In addition, it has been also proven that it is most preferable that the injection angle $\phi$ be equal to an approximate 90 degree.

When the opening degree of the throttle valve 12 is small and, thus, the engine is operating under a light load as illustrated in FIG. 2, based on observations using the schlieren photography process, it has been proven that the velocity of the air flowing between the right valve plate **12*a* and the inner wall of the intake passage 7 is higher than that of the air flowing between the left valve plate 12*b* and the inner wall of the intake passage 7, and that, after the air stream which has passed between the right valve plate 12*a* and the inner wall of the intake passage 7 moves downwards towards the center of the intake passage 7 away from the inner wall of the intake passage 7, as illustrated by the arrow A in FIG. 2, the air stream again approaches the inner wall of the intake passage 7, and then flows downwards along the inner wall of the intake passage 7. Consequently, if the fuel nozzle 14 of the fuel injector 13 is spaced below the throttle shaft 11 by the distance L, the fuel injected from the fuel injector 13 is pushed towards the central portion of the intake passage 7 by the air stream flowing as illustrated by the arrow A in FIG. 2 and, as a result, the fuel injected from the fuel injector 13 is uniformly distributed within the intake passage 7. In addition, by using the swirl type fuel injector 13, the atomization of the fuel is promoted. Furthermore, since the fuel injector 13 is arranged at a position downstream of the right valve plate 12*a*, so that the air stream passing around the right valve plate 12*a* at a speed which is higher than that of the air stream passing around the left valve plate 12*b* flows in front of the fuel nozzle 14 of the fuel injector 13, the fuel injected from the fuel nozzle 13 is divided into fine droplets by the higher speed air stream, and thus, the atomization of the fuel is further promoted. In addition, the atomization of the fuel injected from the fuel injector 13 is further promoted by the air stream spouted from the air ports 17 and, since the mixing operation between the fuel and the sucked air is promoted by the strong swirl motion S caused by the air streams spouted from the air ports 17, a homogeneous mixture is created over the entire region of the intake passage 7. Then, the mixture flows into the collecting portion 3 of the intake manifold 2 together with the sucked air. At this time, the liquid fuel adhering onto the inner wall of the intake passage 7 and flowing downwards along the inner wall of the intake passage 7 is sheared into fine droplets at the knife edge shape lower end 10 of the cylindrical member 9 and, thus, the atomization of the liquid fuel adhering onto the inner wall of the intake passage 7 is promoted. After this, the vaporization of the fuel flowing into the collecting portion 3 is promoted during the time the fuel flows within the intake manifold 2 and, then, the fuel is fed into the cylinders of the engine. As mentioned above, since the atomization and the vaporization of the fuel are promoted when the fuel injected from the fuel injector 13 flows into the collecting portion 3 of the intake manifold 2, the distribution of the fuel to each cylinder becomes uniform. In addition, since the fuel injected from the fuel injector 13** is immediately fed into the cylinders of the engine, a good responsiveness of the controlling operation of the fuel injection can be obtained.

Figure 7:
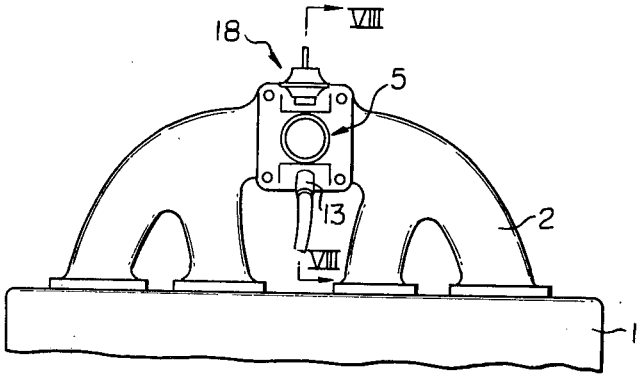
FIG. 7 is a plan view of a part of an alternative embodiment.
Figure 9:
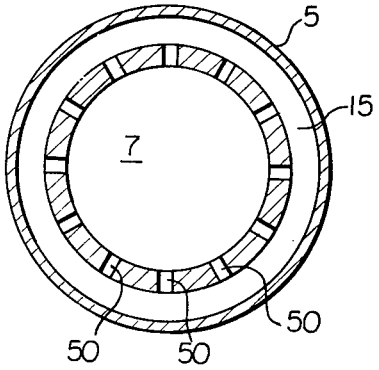
FIG. 9 is a cross-sectional view taken along the line IX—IX in FIG. 8.
Figure 8:
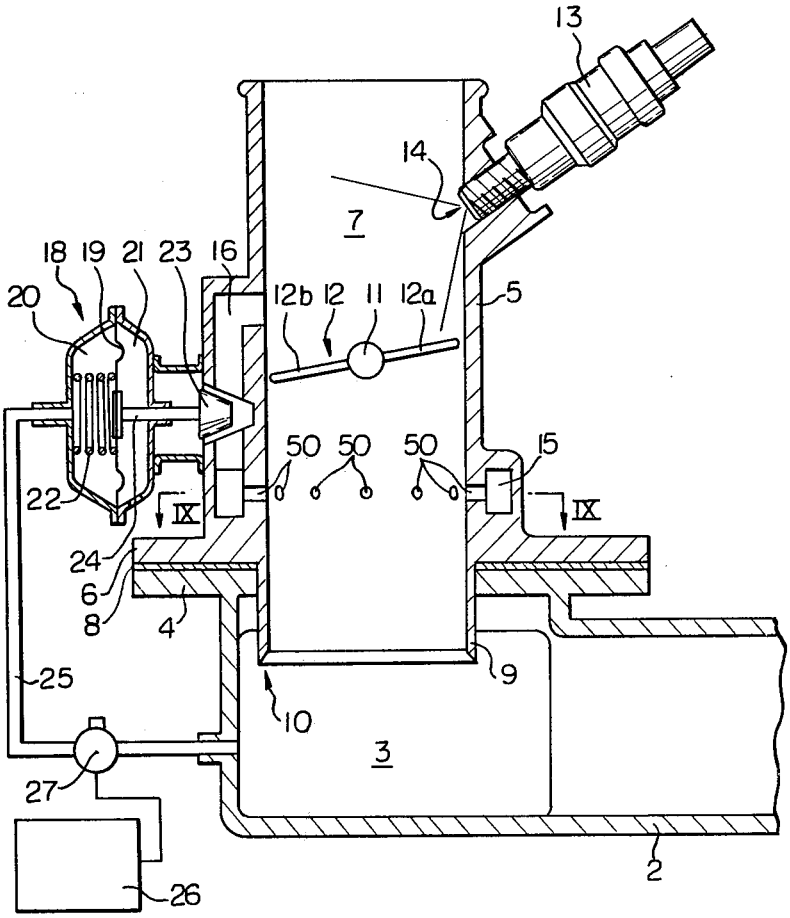
FIG. 8 is a cross-sectional side view taken along the line VIII—VIII in FIG. 7.

FIGS. 7 through 9 illustrate an alternative embodiment according to the present invention. In FIGS. 7 through 9, similar components are indicated with the same reference numerals used in FIGS. 1 through 3. As illustrated in FIG. 8, in this embodiment, the fuel injector 13 is arranged in the intake passage 7 at a position located upstream of the throttle valve 12, and the nozzle 14 of the fuel injector 13 is directed slightly downwards towards the throttle valve 12. In addition, as illustrated in FIGS. 8 and 9, a plurality of air ports 50 communicating the annular passage 15 with the intake passage 7 are arranged on the inner wall of the intake passage 7 so as to be equally spaced, so that all the air ports 50 are directed towards the center of the intake passage 7. Consequently, in this embodiment, a part of the sucked air is spouted from the air ports 50 towards the center of the intake passage 7. Particularly when the opening degree of the throttle valve 12 is small, the mixture formed in the intake passage 12 located upstream of the throttle valve 12 is divided into two mixture streams flowing along the inner walls of the intake passage 7, which are positioned beneath the peripheral edges of the right valve plate 12*a* and the left valve plate 12*b*, respectively, after the mixture passes through the throttle valve 12. However, since the mixture streams which have passed through the throttle valve 12 are pushed towards the central portion of the intake passage 7 by the air stream spouted from the air ports 50, the mixing operation between the fuel and the sucked air is promoted and, as a result, the distribution of fuel to each cylinder becomes uniform.

In the embodiments illustrated in FIGS. 2 and 8, the fuel is intermittently injected from the fuel injector 13, and the amount of the fuel injected from the fuel injector 13 is controlled by the electronic control circuit 49 so that an optimum air fuel ratio of the mixture fed into the cylinders is always obtained in accordance with a change in the operating condition of the engine. However, instead of intermittently injecting the fuel from the fuel injector 13, the fuel may be continuously injected from the fuel injector 13.

When the amount of the sucked air is large, since the sucked air flows within the intake passage 7 at a high speed, the atomization of the fuel is fully promoted. Consequently, at this time, the distribution of fuel to each cylinder becomes uniform independently of the location and the injecting direction of the fuel injector. However, when the amount of the sucked air is small, that is, when the engine is operating in an idling condition or under a partial load, since the velocity of the sucked air flowing within the intake passage 7 is very low, the atomization of the fuel, which is caused by the sucked air, is not expected. Nevertheless, in the present invention, by using a swirl type fuel injector and spouting a part of the sucked air into the intake passage, the atomization and the vaporization of the fuel injected from the fuel injector are greatly promoted. Consequently, even if the amount of the sucked air is small, the distribution of fuel to each cylinder becomes uniform.

While the invention has been described by reference to specific embodiments chosen for purposes of illustration, it should be apparent that numerous modifications could be made thereto by those skilled in the art without departing from the spirit and scope of the invention.

What is claimed is:

1. A vehicle equipped with a fuel injection type internal combustion engine comprising:

an engine body;

an intake duct fixed onto said engine body and defining an intake passage therein;

a throttle valve arranged in said intake-passage;

a fuel injector having a fuel nozzle arranged in said intake passage;

bypass means communicating said intake passage located upstream of said throttle valve and said intake passage located downstream of said throttle valve;

a vacuum operated flow control device arranged in said bypass means and operated in response to changes in the level of the vacuum produced in said intake duct;

a vehicle cooling system;

a steering system having a steering handle; and a torque converter having a manual control handle, wherein said vacuum operated flow control device comprises:

a diaphragm apparatus having a vacuum chamber connected to an inside of said intake duct via a vacuum conduit;

an electromagnetic valve arranged in said vacuum conduit;

a first switch cooperating with said throttle valve and turned to the ON condition when said throttle valve is in the idling position;

a second switch connected to said cooling system and turned to the ON condition when said cooling system is operated;

a third switch connected to said steering system and turned to the ON condition when said steering handle is turned to its extreme position;

a fourth switch turned to the ON condition when the temperature of said engine body is below a predetermined level;

a fifth switch connected to said torque converter and turned to the ON condition when said manual control handle is positioned at the auto-drive range; and an electronic control circuit for actuating said electromagnetic valve in response to output signals of said first, second, third, fourth and fifth switches to establish a connection between said vacuum chamber and the inside of said intake duct when said first switch is turned to the ON condition and when at least one of said second, third, fourth and fifth switches is turned to the ON condition.

2. A vehicle equipped with a fuel injection type internal combustion engine as claimed in claim 1, wherein said intake duct comprises an intake manifold having a collecting portion, and an intake duct portion substantially vertically and upwardly extending from said collecting portion, said throttle valve being arranged in said intake duct portion, said fuel injector being arranged in said intake duct portion at a position located downstream of said throttle valve.

3. A vehicle equipped with a fuel injection type internal combustion engine as claimed in claim 2, wherein said throttle valve has a throttle shaft horizontally extending in parallel with a longitudinal axis of said engine body, the fuel nozzle of said fuel injector being arranged at a position near said engine body with respect to said throttle shaft.

4. A vehicle equipped with a fuel injection type internal combustion engine as claimed in claim 2, wherein the fuel nozzle of said fuel injector is directed slightly downwards.

5. A vehicle equipped with a fuel injection type internal combustion engine as claimed in claim 2, wherein the fuel nozzle of said fuel injector is arranged at a position downwardly remote from said throttle shaft by a distance which is less than one half of the diameter of said intake duct portion.

6. A vehicle equipped with a fuel injection type internal combustion engine as claimed in claim 1, wherein said fuel injector is a swirl type injector.

7. A vehicle equipped with a fuel injection type internal combustion engine as claimed in claim 6, wherein the injection angle of said fuel injector is in the range of 60 through 120 degrees.

8. A vehicle equipped with a fuel injection type internal combustion engine as claimed in claim 7, wherein said injection angle is about 90 degrees.

9. A vehicle equipped with a fuel injection type internal combustion engine as claimed in claim 1, wherein said intake duct comprises an intake manifold having a collecting portion, and an intake duct portion substantially vertically and upwardly extending from said collecting portion, said throttle valve being arranged in said intake duct portion, said fuel injector being arranged in said intake duct portion at a position located upstream of said throttle valve.

10. A vehicle equipped with a fuel injection type internal combustion engine as claimed in claim 9, wherein the fuel nozzle of said fuel injector is directed downwards towards said throttle valve.

11. A vehicle equipped with a fuel injection type internal combustion engine as claimed in claim 1, wherein said intake duct comprises an intake manifold having a collecting portion, and an intake duct portion substantially vertically and upwardly extending from said collecting portion, said throttle valve being arranged in said intake duct portion, said fuel injector being arranged in said intake duct portion.

12. A vehicle equipped with a fuel injection type internal combustion engine as claimed in claim 11, wherein said intake duct portion has on its lower end a cylindrical member projecting downwards into said collecting portion and arranged to be spaced from a circumferential wall of said collecting portion.

13. A vehicle equipped with a fuel injection type internal combustion engine as claimed in claim 12, wherein said cylindrical member has a lower end having a knife edge shape.

14. A vehicle equipped with a fuel injection type internal combustion engine as claimed in claim 1, wherein said intake duct comprises an intake manifold having a collecting portion, and an intake duct portion substantially vertically and upwardly extending from said collecting portion, said throttle valve being arranged in said intake duct portion, said fuel injector being arranged in said intake duct portion, said bypass means comprising a bypass passage which has an air outlet connected to an inside of said intake duct portion located downstream of said throttle valve.

15. A vehicle equipped with a fuel injection type internal combustion engine as claimed in claim 14, wherein said air outlet comprises a plurality of air ports formed on an inner wall of said intake duct portion and arranged at the same level.

16. A vehicle equipped with a fuel injection type internal combustion engine as claimed in claim 15, wherein each of said air ports is tangentially connected to said inner wall circumferentially extending about an axis of said intake duct portion.

17. A vehicle equipped with a fuel injection type internal combustion engine as claimed in claim 15, wherein each of said air ports is directed towards an axis of said intake duct portion.

* * * * *